US005578134A

United States Patent [19]

Lentsch et al.

[11] Patent Number: 5,578,134

[45] Date of Patent: Nov. 26, 1996

[54] METHOD OF SANITIZING AND DESTAINING TABLEWARE

[75] Inventors: Steven E. Lentsch, St. Paul; Dale W. Groth, Edina; Thomas R. Oakes, Lake Elmo; Burton M. Baum, Mendota Heights, all of Minn.

[73] Assignee: Ecolab Inc., St. Paul, Minn.

[21] Appl. No.: 229,982

[22] Filed: Apr. 19, 1994

[51] Int. Cl.[6] ..... B08B 3/04; B08B 3/08; C23G 1/02

[52] U.S. Cl. ..... 134/3; 134/25.2; 134/41; 510/522

[58] Field of Search ..... 134/3, 41, 25.2; 252/174.19, 106

[56] References Cited

U.S. PATENT DOCUMENTS

| | | | |
|---|---|---|---|
| Re. 30,537 | 3/1981 | Fraula et al. | 134/10 |
| 349,852 | 9/1886 | Marchand | 426/332 |
| 1,772,975 | 8/1930 | Wieland | 514/557 |
| 2,466,663 | 4/1949 | Russ et al. | 514/494 |
| 2,592,884 | 4/1952 | Fox et al. | 299/84 |
| 2,592,885 | 4/1952 | Fox et al. | 134/38 |
| 2,592,886 | 4/1952 | Fox et al. | 299/85 |
| 2,833,813 | 5/1958 | Wallace | 260/502 |
| 3,044,092 | 7/1962 | Fox et al. | 15/75 |
| 3,146,718 | 9/1964 | Fox et al. | 103/38 |
| 3,297,456 | 1/1967 | Newell | 106/13 |
| 3,370,597 | 2/1968 | Fox | 134/58 |
| 3,592,774 | 7/1971 | Altenschpfer | 252/89 |
| 3,625,901 | 12/1971 | Rue | 252/89 |
| 3,650,965 | 3/1972 | Cantor et al. | 252/106 |
| 3,867,300 | 2/1975 | Karabinos et al. | 252/106 |
| 3,915,633 | 10/1975 | Ramachandran | 134/3 |
| 3,941,713 | 3/1976 | Dawson et al. | 252/142 |
| 4,002,775 | 1/1977 | Kabara | 426/532 |
| 4,005,024 | 1/1977 | Rodriguez et al. | 252/89 R |
| 4,011,346 | 3/1977 | Ernst | 426/104 |
| 4,051,058 | 9/1977 | Böwing et al. | 252/186 |
| 4,051,059 | 9/1977 | Böwing et al. | 252/186 |
| 4,147,559 | 4/1979 | Fraula et al. | 134/101 |
| 4,187,121 | 2/1980 | Herold et al. | 134/26 |
| 4,203,765 | 5/1980 | Claeys et al. | 430/252 |
| 4,376,787 | 3/1983 | Lentsch et al. | 424/315 |
| 4,404,040 | 9/1983 | Wang | 134/22.14 |
| 4,406,884 | 9/1983 | Fawzi et al. | 424/81 |
| 4,410,442 | 10/1983 | Lucas et al. | 252/107 |
| 4,430,381 | 2/1984 | Harvey et al. | 428/284 |
| 4,534,945 | 8/1985 | Hopkins et al. | 434/273 |
| 4,557,935 | 12/1985 | af Ekenstam et al. | 424/130 |
| 4,624,713 | 11/1986 | Morganson et al. | 134/25.2 |
| 4,647,458 | 3/1987 | Ueno et al. | 424/128 |
| 4,715,980 | 12/1987 | Lopes et al. | 252/106 |
| 4,776,974 | 10/1988 | Stanton et al. | 252/106 |
| 4,900,721 | 2/1990 | Bansemir et al. | 514/25 |
| 4,920,100 | 4/1990 | Lehmann et al. | 514/23 |
| 4,945,110 | 7/1990 | Brokken et al. | 514/517 |
| 5,013,560 | 5/1991 | Stentz et al. | 424/653 |
| 5,017,617 | 5/1991 | Kihara et al. | 514/635 |
| 5,234,719 | 8/1993 | Richter et al. | 252/106 |
| 5,320,805 | 6/1994 | Kramer et al. | 252/106 |
| 5,330,769 | 7/1994 | McKinzie et al. | 252/106 |

FOREIGN PATENT DOCUMENTS

| | | |
|---|---|---|
| 1174976 | 9/1984 | Canada . |
| 0021504 | 1/1981 | European Pat. Off. . |
| 0068552 | 1/1983 | European Pat. Off. . |
| 0083820 | 7/1983 | European Pat. Off. . |
| 0147102 | 12/1983 | European Pat. Off. . |
| 0097995 | 1/1984 | European Pat. Off. . |
| 0218441 | 4/1987 | European Pat. Off. . |
| 0245928 | 11/1987 | European Pat. Off. . |
| 0244144 | 11/1987 | European Pat. Off. . |
| 0288689 | 11/1988 | European Pat. Off. . |
| 0375827 | 7/1990 | European Pat. Off. . |
| 59-157007 | 9/1984 | Japan . |
| 62-048612 | 3/1987 | Japan . |
| 1135643 | 12/1968 | United Kingdom . |
| 2076286 | 12/1981 | United Kingdom . |
| 2103089 | 2/1983 | United Kingdom . |
| 2187097 | 9/1987 | United Kingdom . |
| 2189394 | 10/1987 | United Kingdom . |
| 2211093 | 6/1989 | United Kingdom . |
| WO83/00163 | 1/1983 | WIPO . |
| WO87/03799 | 7/1987 | WIPO . |
| WO87/06470 | 11/1987 | WIPO . |
| WO91/05842 | 5/1991 | WIPO . |
| WO93/01716 | 4/1993 | WIPO . |

OTHER PUBLICATIONS

Derwent Publications Ltd., London, Great Britain, AN86–229179 & JP–A–61 159 498 (Kao Corp), 19 Jul. 1986.

Food Acidulants, pp. 7, 13, 44 and Chapter 8, pp. 97–114 no date.

Kirk–Othmer Encyclopedia of Chemical Technology, Third Edition: Dicarboxylic Acids, vol. 7, pp. 614–628 no date.

Kirk–Othmer Encyclopedia of Chemical Technology, Third Edition: Carbonated Beverages, vol. 4, pp. 712–713 no date.

Kirk–Othmer Encyclopedia of Chemical Technology, Third Edition: Citric Acid, vol. 6, pp. 150–178.

Kirk–Othmer Encyclopedia of Chemical Technology, Third Edition: Hydroxy Carboxylic Acids, vol. 13, pp. 80–120.

(List continued on next page.)

*Primary Examiner*—Zeinab El-Arini

*Attorney, Agent, or Firm*—Merchant, Gould, Smith, Edell, Welter & Schmidt

[57] ABSTRACT

A method of sanitizing and destaining ware, including silverware includes the steps of applying a sanitizing concentrate composition to silverware at a rate of 100 ppm to 2000 ppm, the sanitizing concentrate composition including from about 1 wt-% to 20 wt-% of peroxycarboxylic acid, from about 10 wt-% to 50 wt-% of carboxylic acid containing a mixture of acetic acid, and octanoic acid, the acetic acid and the octanoic acid present in a ratio ranging from about 10 to 1 to about 1 to 1, respectively, from about 3 wt-% to 35 wt-% of hydrogen peroxide, and a balance of carrier wherein said peroxycarboxylic acid is the reaction product of the acetic acid, octanoic acid, and hydrogen peroxide.

31 Claims, No Drawings

OTHER PUBLICATIONS

Kirk–Othmer Encyclopedia of Chemical Technology, Third Edition: Carboxylic Acids, vol. 4, pp. 814–834 and pp. 855–871 no date.

Disinfection, Sterilization, and Preservation, Fourth Edition, Seymour S. Block, 1991, Chapter 47, "Chemical Food Preservatives" no month.

Disinfection, Sterilization, and Preservation, Second Edition, Seymour S. Block, 1977, Chapter 16, "Acid–Anionic Surfactant Sanitizers" no month.

Code of Federal Regulations, 21 C.F.R. Ch. 1 (Apr. 1, 1991 Edition), pp. 311–318.

Kirk–Othmer, Encyclopedia of Chemical Technology, Third Edition, vol. 12, pp. 46, 61 and 62 no date.

The Food Chemical News Guide, Oct. 7, 1991.

The Food Chemical News Guide, Jun. 26, 1989.

Clinical Toxicology of Commercial Products, Fifth Edition, Gosselin et al, Section III, Ethylene Glycol, 1984, p. 172 no month.

Industrial Gums Polysaccharides and Their Derivatives, Whistler, Second Edition, Chapter XIX, Pectin, Towle et al, pp. 429–455 no date.

Food Science and Technology, "A Series of Monographs," Stewart et al, pp. 186–187 no date.

Chemical Abstracts, Abstract No. 95723, vol. 111, p. 610, (Sep. 11, 1989).

Food Chemical Codex, Second Edition, Committee on Specification . . . , pp. 12–14, 1972 no month.

Schick, "Nonionic Surfactants", published by Marcel Dekker and John L. Wilson, *Soap and Chemical Specialties,* Feb. 1958, Rinse Additives, pp. 48–52 and 170–171.

Solvent Properties of Surfactant Solutions, vol. 2, Frederic R. Benson, 1967 Nonionic Surfactants, pp. 260–297 no month.

Research Note: Salmonella Decontamination of Broiler Carcasses with Lactic Acid, L–Cysteine, and Hydrogen Peroxide by R. W. A. W. Mulder et al., pp. 1555–1557, Nov. 7, 1986.

17–Food, Feed Chem. vol. 108, 1988, 108:166345q Disinfectant compositions containing aqueous lower alcohol, acidic component, and amino– or ammonium–based microbicide, p. 549.

17–Food, Feed Chem. vol. 111, 1989, 111:95723k Study of calcium binding to phosphoserine residues of –casein and its phosphopeptide (1–25) by $^{31}$P NMR no month.

63–Pharmaceuticals, vol. 102, 1985, 102:32300p Germ–killing materials no month.

63–Pharmaceuticals, vol. 70, 1969, 60796u Antibiotic and mucolytic compositions no month.

PCT International Search Report.

METHOD OF SANITIZING AND DESTAINING TABLEWARE

FIELD OF THE INVENTION

The invention relates generally to methods for sanitizing and destaining ware products including ware products made from metal alloys such as steel, silver, and silver plated ware. More specifically, the invention relates to methods for rinsing and sanitizing ware articles with peroxyacid compositions. The method is especially useful in sanitizing and destaining ware comprising silver due to its low corrosivity. The composition of the invention may generally be used in manual and automated rinse operations as well as the rinse cycle in the operation of commercial and institutional settings. Environments where the method of the invention may find use include, for example, hospitals, restaurants, daycare centers, hotels, cafeterias, carry-away food service establishments, and other installations where cooking utensils, as well as table and dishware are frequently used and reused during a meal period.

BACKGROUND OF THE INVENTION

In high volume institutional food preparation and service installations, chemical sanitizing compositions are often used in automated or manual warewashing to destroy bacteria during rinsing operations to meet minimum sanitation standards. In many installations sanitation standards are met through the use of very high temperature rinse water (180°–195° F.). Where such temperatures are not achievable, a chemical sanitizing agent is often added to one or more aqueous material that contacts kitchenware or tableware to produce a bacteria killing effect at the low temperature conditions of approximately 120°–140° F. The use of the terms "high temperature" and "low temperature" herein relate approximately to the above temperature ranges.

Low temperature methods and equipment are illustrated in the following, Fox et al., U.S. Pat. Nos. 2,592,884, 2,592,885, and 2,592,886, 3,044,092 and 3,146,718, as well as Fox, U.S. Pat. No. 3,370,597. In large part, these machines follow a cleaning regimen wherein the soiled kitchenware or tableware can be prescraped either manually or with an automatic machine scraping stage involving a water spray to remove large bulk soil. The ware can then be directed to a zone wherein the ware is contacted with an aqueous alkaline cleaning composition that acts to remove soil by attacking protein, fat or carbohydrate soils chemically. The cleaned ware can then be directed to a sanitizing stage wherein the ware is contacted with sanitizer material or directed to a combined rinsing-sanitizing stage where the ware is contacted with a combination of rinse agent and sanitizer. Lastly, the ware can be directed to a stage where the articles are dried either actively by heating or passively by ambient evaporation.

The need for sanitization has lead to the consideration of various agents. One of the most common sanitizers for warewashing is aqueous sodium hypochlorite (NaOCl). However, while sodium hypochlorite is effective, low cost and generally available, sodium hypochlorite has several disadvantages. First, hypochlorite can react with hardness ions in service water including calcium, magnesium, iron, manganese, etc. Such chemical interaction can cause liming and mineral deposits on machine parts. Such deposits can tend to form in and on the water passages of a warewashing machine which can substantially change the flow rates of various aqueous materials through the machine. Any such change can seriously reduce the effectiveness of machine operation. Chlorine, as a constituent of sodium hypochlorite, may also present compatibility problems when used with other chemicals which have desirable sheeting and rinse aid characteristics, such as nonionic surfactants. Further, the interaction between sodium hypochlorite and various minerals in service water can result in the spotting and filming of ware products.

Sodium hypochlorite is also a strong oxidizing chemical and can substantially corrode a variety of materials used in machine manufacture and in tableware and kitchenware commonly used in today's institutional environment. Chlorine may also react and degrade or corrode tableware comprising silver or a silver plate finish. The degradation product is the reaction product of ionic silver and other elemental ions in which the silver metal comes into contact. Silver rapidly compounds to form, for example, silver oxides and silver halogens, in particular silver chloride when exposed to chlorine from, for example, sodium hypochlorite.

In the meantime, various rinse aid compositions have been developed for use in both low temperature and high temperature wash systems. For example, Fraula et al., U.S. Pat. No. 4,147,559 and U.S. Pat. No. Re. 30,537 teach an apparatus and a method for rinsing and chemically sanitizing foodware items. The disclosure is primarily directed to machine related components for ensuring adequate cleaning and sanitizing.

Further, a number of rinse aid compositions, based largely on nonionic surfactants without sanitizers are also known. Altenschopfer, U.S. Pat. No. 3,592,774, teaches saccharide-based nonionic rinsing agents. Rue et al., U.S. Pat. No. 3,625,901, teach surfactants used as rinse aids having low foaming properties. Dawson et al., U.S. Pat. No. 3,941,713, teach machine warewashing rinse agents having an anti-resoiling or nonstick additive for treating aluminum or other such metal kitchenware. Rodriguez et al., U.S. Pat. No. 4,005,024, teach a rinse aid composition containing organosilane and monofunctional organic acids that act as rinse agents. Herold et al., U.S. Pat. No. 4,187,121, teach a rinse agent concentrate based on saccharide glycol ether technology.

Further, Morganson et al., U.S. Pat. No. 4,624,713, teach a solidified rinse agent composition containing a nonionic rinsing agent, urea, water and other components. Surveys of nonionic surfactants and rinse additives containing nonionic surfactants are found in Schick, "Nonionic Surfactants", published by Marcel Dekker, and John L. Wilson, *Soap and Chemical Specialties,* February 1958, pp. 48–52 and 170–171.

However, none of these rinse aids have been able to combine effective sheeting and rinsing action with sanitizing efficacy to create a sanitizing composition which is favorable to ware products comprising silver. Accordingly, a strong need exists in the art to provide a rinsing sanitizing agent that can promote sheeting and removal of spotting, provide substantial sanitizing action and result in operations without any substantial deposit formation on ware, dish machines or corrosion of machine components or kitchenware, tableware, or tarnish formation of ware products comprising silver.

BRIEF DESCRIPTION OF THE INVENTION

In accordance with a first aspect of the invention, there is provided method of sanitizing and destaining ware products comprising the step of applying a sanitizing rinse composition to the ware. The sanitizing rinse composition generally comprises a peroxycarboxylic acid, a carboxylic acid, hydrogen peroxide, and a balance of aqueous carrier.

In accordance with a more preferred aspect of the invention, there is provided a method of sanitizing and destaining silverware. The method comprises the steps of washing the silverware in an automated warewashing machine and applying about 100 ppm to 2000 ppm of a sanitizing concentrate composition. The sanitizing concentrate composition comprises from about 5 wt-% to 75 wt-% of a carboxylic acid mixture comprising acetic acid and octanoic acid; from about 1 wt-% to 40 wt-% of hydrogen peroxide; and from about 0.5 wt-% to 25 wt-% of a peroxycarboxylic acid resulting from the reaction of the carboxylic acid and the hydrogen peroxide, optionally a carboxylic acid solubilizer, and a balance of aqueous carrier. The rinsing may be completed in high temperature or low temperature water.

The invention is a method for destaining and sanitizing ware products. The invention generally provides improved destaining and sanitization, but does not cause significant corrosion of machine parts or ware. We have found that the effective concentration of the materials result in low total solids formulations which substantially resist spotting. Lastly, the carboxylic acids to which the peroxyacid materials degrade are non-toxic, non-corrosive as well as non-film forming and are compatible with commonly available materials used in the manufacture of dish machines, kitchenware, tableware and glassware.

For the purpose of this invention, the term "sheeting or rinse agent" refers to the chemical species that causes the aqueous rinse to sheet. The term "rinse aid" reflects the concentrated material which is diluted with an aqueous diluent to form aqueous rinse. The terms "ware, tableware, kitchenware or dishware" refers to various types of articles subject to tarnish, discoloration or degradation used in the preparation, serving and consumption of foodstuffs including pots, pans, baking dishes, processing equipment, trays, pitchers, bowls, plates, saucers, cups, glass, forks, knives, spoons, spatulas, grills, griddles, burners and the like made or fabricated from thermosetting or thermoplastic polymers, ceramics such as blown or fired glasses and plates, and elemental and alloyed metal such as silver, copper, bronze, and steel among other materials. The term "silverware" includes any of the "ware, tableware, kitchenware or dishware" that comprises silver, or a silver compound including silver salts, silver oxides, etc. The term "rinsing" or "sheeting" relates to the capacity of the aqueous rinse when in contact with table ware to form a substantially continuous thin sheet of aqueous rinse which drains evenly from the ware leaving little or no spotting upon evaporation of the water.

The invention is concerned primarily with low temperature equipment in cleaning and sanitizing articles, but can be applicable to high temperature machines to provide an increased degree of confidence that ware are adequately destained and sanitized.

DETAILED DESCRIPTION OF THE INVENTION

The invention is a method of sanitizing and destaining ware products, including silverware. The method of the invention includes the application of a sanitizing composition comprising a peroxycarboxylic acid reaction product of one or more carboxylic acids and an oxidizer. Optionally the composition of the invention may also comprise oxidizer stable sequestrants and solubilizers as well as other adjuvants such as carriers, sheeting agents, etc. which are also stable in the presence of an oxidizer.

The sanitizing, destaining composition is typically formulated in a liquid diluent compatible with any rinse aids present in the system in concentrated or dilute form. The uniqueness of the invention relates to the fact that the active components (1) are stable at substantial concentrations in the undiluted concentrate, (2) are significant improvements over the use of sodium hypochlorite in an aqueous rinse, and (3) provide effective sanitizing and improved ware appearance. Lastly, the compositions of the invention are non-corrosive and non-filmforming in contact with materials common in the automatic dish machines and in ware, particularly silverware.

A. The Sanitizing and Destaining Concentrate

The composition of the invention contains a peroxycarboxylic acid sanitizing composition. The peroxycarboxylic sanitizer material generally comprises at least two monocarboxylic acid each having from 2 to about 18 carbon atoms. Commonly, the peroxycarboxylic material can be made by oxidizing a monocarboxylic acid directly to the peroxycarboxylic material which is then solubilized in the compositions of the invention. Further, the materials can be made by combining the unoxidized acid with hydrogen peroxide to generate the acid in situ either prior to blending the fatty peracid with any added components or after the added components are formulated.

Generally when the peroxycarboxylic acid is formulated in accordance with the invention a mono carboxylic acid, such as acetic acid, is combined with an oxidizer such as hydrogen peroxide. The result of this combination is a reaction producing a peroxycarboxylic acid, such as peroxyacetic acid, and water. The reaction follows an equilibrium in accordance with the following equation:

$$H_2O_2+RCOOH \rightleftharpoons RCOOOH+H_2O$$

wherein the $K_{eq}$ is 2.0.

The importance of the equilibrium stems from the presence of hydrogen peroxide, the carboxylic acid and the peroxycarboxylic acid in the same composition at the same time. This combination provides enhanced sanitizing with none of the deleterious corrosive or filming effects of other rinse agents, additives, or compositions.

The first constituent of the equilibrium mixture comprises one or more carboxylic acids. The carboxylic acids function as a precursor for the reaction product peroxycarboxylic acid while providing a source of acidity and antimicrobial efficacy. The acidity stabilizes and otherwise assists in maintaining the equilibrium concentration of the peroxycarboxylic acid.

Specific examples of suitable $C_2$–$C_{18}$ carboxylic acids which can be used to make the peracid materials or to combine with hydrogen peroxide to form peracid materials include fatty acids as acetic acid, and octanoic acids.

These acids can be drawn from both natural or synthetic sources. Natural sources include animal and vegetable fats or oils which should be fully hydrogenated. Synthetic acids can be produced by the oxidation of petroleum wax. We have found that the claimed method provides preferable sanitizing and rinsing result when any number of carboxylic acid are used. However, more preferable embodiments of the invention comprise the combined use of acetic and octanoic acids or derivatives thereof. Derivatives of these acids include acid-salts, acid-esters, as well as all naturally occurring derivatives found in commercial preparations of fatty acids such as trace concentrations of shorter and longer chain fatty acids and fatty acid derivatives. When used in combination, the ratio of acetic acid to octanoic acid ranges from about 20 to 1 to about 1 to 2 and more preferably 10 to 1 to about 1 to 1, respectively.

The composition of the invention also comprises an oxidizer. Any number of oxidizers may be used as a precursor to the formation of a peroxycarboxylic acid. Generally, the antimicrobial composition of the invention comprises hydrogen peroxide. Hydrogen peroxide in combination with the carboxylic acid and peroxycarboxylic acid provides a surprising level of antimicrobial action against microorganisms, even in the presence of high loadings of organic sediment.

An additional advantage of hydrogen peroxide is the nontoxic nature of this composition upon use and decomposition. For example, combinations of peroxyacetic acid and hydrogen peroxide result in acetic acid, water, and oxygen upon decomposition. All of these constituents have been approved for use on food contact surfaces.

Hydrogen peroxide ($H_2O_2$), has a molecular weight of 34.014 and is a weakly acidic, clear, colorless liquid. The four atoms are covalently bonded in a H—O—O—H structure. Generally, hydrogen peroxide has a melting point of −0.41° C., a boiling point of 150.2° C., a density at 25° C. of 1.4425 grams per $cm^3$, and a viscosity of 1.245 centipoise at 20° C.

Generally, the concentration of hydrogen peroxide within the concentrate composition used in the process of the invention ranges from about 1 wt-% to about 40 wt-%, preferably from about 3 wt-% to about 35 wt-%, and most preferably from about 5 wt-% to about 30 wt-%. This concentration of hydrogen peroxide is most preferred as providing optimal antimicrobial effect in an equilibrium concentrate mixture.

The other principle component of the antimicrobial composition of the invention is an oxidized carboxylic acid. This oxidized or peroxycarboxylic acid provides heightened antimicrobial efficacy when combined with hydrogen peroxide and the monocarboxylic acid in an equilibrium reaction mixture. Generally, any number of peroxycarboxylic acids are useful in accordance with the method of the invention.

Percarboxylic acids generally have the formula $R(CO_3H)_N$, where R is an alkyl, aryl alkyl, cyclo alkyl aromatic or heterocyclic group, and N is one or more.

Particularly preferred peroxy acids for use in the composition and method of invention include peroxyacetic acid when used in combination with peroxyoctanoic acid.

Peroxyacetic acid is a peroxycarboxylic acid having the formula: $CH_3COOOH$.

Generally, peroxyacetic acid is a liquid having an acrid odor and is freely soluble in water, alcohol, ether, and sulfuric acid. Peroxyacetic acid may be prepared through any number of means known to those of skill in the art, including preparation from acetaldehyde and oxygen in the presence of cobalt acetate. A 50% solution of peroxyacetic acid may be obtained by combining acetic anhydride, hydrogen peroxide and sulfuric acid. Other methods of formulation of peracetic acid include those disclosed in U.S. Pat. No. 2,833,813, which is incorporated herein by reference.

In turn, peroxyoctanoic acid is also a peroxycarboxylic acid having the formula $CH_3(CH_2)_6COOOH$. Peroxyoctanoic acid may also be prepared by methods known to those of skill in the art.

The preferred peroxyacetic and peroxyoctanoic acid materials of the invention can be used to increase the sanitizing effectiveness of the materials. The peroxyacetic acid is blended in proportions that range from about 20 to about 1 part of peroxyacetic acid per each part of peroxyoctanoic acid. Preferably, the peroxyacetic acid is used at a ratio of about 10 parts per part of peroxyoctanoic acid.

The above sanitizer material can provide antibacterial activity to the rinse sanitizers of the invention against a wide variety of microorganisms such as gram positive (for example, *Staphylococcus aureus*) and gram negative (for example, *Escherichia coli*) microorganisms, yeast, molds, bacterial spores, viruses, etc. When combined, the above peroxy acids can have enhanced activity compared to the low molecular weight peroxy acids alone.

The composition of the invention also comprises the carrier. The carrier functions to provide a reaction medium for the solubilization of constituents and the production of peroxycarboxylic acids as well as a medium for the development of an equilibrium mixture of oxidizer, peroxycarboxylic acid, and carboxylic acid. The carrier also functions to deliver and wet the antimicrobial composition of the invention to the intended substrate.

To this end, the carrier may comprise an aqueous or organic component or components which will facilitate these functions. Generally, the carrier comprises water which is an excellent solubilizer and medium for reaction and equilibrium. Water is also readily accepted in warewashing environments. The carrier may also comprise any number of other constituents such as various organic compounds which facilitate the functions provided above. Organics which can be used include simple alkyl alcohols such as ethanol, isopropanol, n-propanol, and the like. Polyols are also useful carriers in accordance with the invention, including propylene glycol, polyethylene glycol, glycerol, sorbitol, and the like. Any of these compounds may be used singly or in combination with other organic or inorganic constituents or, in combination with water or mixtures thereof.

Generally, the carrier comprises a large portion of the composition of the invention and may essentially be the balance of the composition apart from the active antimicrobial composition, adjuvants, and the like. Here again, the carrier concentration and type will depend upon the nature of the composition as a whole, the environment of storage, and method of application including concentration of the antimicrobial agent, among other factors. Notably, the carrier should be chosen and used at a concentration which does not inhibit the antimicrobial efficacy of the active in the composition of the invention.

B. Adjuvants

The composition of the invention may comprise any number of adjuvants which are stable in an oxidizing environment, do not film silverware and add beneficial properties of stability, sequestration, sheeting and rinsing, etc.

Chelating Agent

The compositions of the invention may also contain a polyvalent metal complexing or chelating agent that aids in reducing the harmful effects of hardness components and service water. The typically harmful effects of calcium, magnesium, iron, manganese, etc., ions present in service water can interfere with the action of either the washing compositions or sanitizing compositions or can tend to decompose the active peroxygen sanitizer materials. The chelating agent or sequestering agent can effectively complex and remove such ions from inappropriate interaction with active ingredients thus increasing performance of the composition of the invention.

Both organic and inorganic chelating agents may be used. Inorganic chelating agents include such compounds as sodium tripolyphosphate and other higher linear and cyclic polyphosphate species. Organic chelating agents include both polymeric and small molecule chelating agents. Polymeric chelating agents commonly comprise polyanionic compositions such as polyacrylic acid compounds. Small molecule organic chelating agents include salts of ethylene diamine tetraacetic acid and hydroxy ethylene diamine tetraacetic acid, diethylene triamine penta acetic acid, nitrilotriacetic acid, ethylene diamine tetrapropionates, triethylene tetraamine hexacetates and the respective alkali metal, ammonium and substituted ammonium salts thereof. Amino phosphates and phosphonates are also suitable for use as chelating agents in the compositions of the invention and include ethylene diamine (tetramethylene phosphonates), nitrilotrismethylene phosphates, diethylenetriamine (pentamethylene phosphonates). These amino phosphonates commonly contain alkyl groups with less than 8 carbon atoms.

Preferred chelating agents for use in this invention include improved food additive chelating agents such as disodium salts of ethylene diamine tetraacetic acid or the well known phosphonates sold in the form of DEQUEST® materials, for example, 1-hydroxyethylidene-1,1-diphosphonic acid, etc. The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid. Sources of phosphonic acids include organic phosphonic acids such as ($CH_3C(PO_3H_2)_2OH$), available from Monsanto Industrial Chemicals Co., St. Louis, Mo., as DEQUEST® 2010, which is a 58–62% aqueous solution; amino [tri(methylenephosphonic acid)] ($N[CH_2PO_3H_2]_3$), available from Monsanto as DEQUEST® 2000, a 50% aqueous solution; ethylenediamine [tetra(methylenephosphonic acid)] available from Monsanto as DEQUEST® 2041, a 90% solid acid product; and 2-phosphonobutane-1,2,4-tricarboxylic acid available from Mobay Chemical Corporation, Inorganic Chemicals Division, Pittsburgh, Pa., as Bayhibit AM, a 45–50% aqueous solution.

The above-mentioned phosphonic acids can also be used in the form of water soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used.

Rinse Agent

A component which may be added to or used with the composition of the invention is the surfactant or surfactant system used to promote sheeting. Generally, any number of surfactants may be used consistent with the purpose of this constituent. For example the surfactant rinse agent may comprise a nonionic, anionic, cationic, or amphoteric surfactant. The surfactant rinse aids may be present in the sanitizing, destaining concentrate of the invention as formulated. Alternatively, these rinse agents may be introduced during application to the ware. In such an instance, regardless of whether automated or manual, the rinse agent may be combined with the concentrate of the invention prior to application or codispensed separately during application.

Anionic surfactants useful with the invention comprise alkyl carboxylates, linear alkylbenzene sulfonates, paraffin sulfonates and secondary n-alkane sulfonates, sulfosuccinate esters and sulfated linear alcohols.

Zwitterionic or amphoteric surfactants useful with the invention comprise β-N-alkylaminopropionic acids, n-alkyl-β-iminodipropionic acids, imidazoline carboxylates, n-alkylbetaines, amine oxides, sulfobetaines and sultaines.

Generally, these surfactants find preferred use in manual applications. The choice of surfactants depends on the foaming properties that the individual, or combination, of surfactants bring to the composition of the invention.

Nonionic surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene (PO)-polyoxyethylene (EO) block copolymers. These surfactants comprise a diblock polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecule. The average molecular weight of useful surfactants ranges from about 1000 to about 40,000 and the weight percent content of ethylene oxide ranges from about 10–80% by weight.

Also useful in the context of this invention are surfactants comprising alcohol alkoxylates having EO, PO and BO blocks. Straight chain primary aliphatic alcohol alkoxylates can be particularly useful as sheeting agents. Such alkoxylates are also available from several sources including BASF Wyandotte where they are known as "Plurafac" surfactants. A particular group of alcohol alkoxylates found to be useful are those having the general formula $R—(EO)_m—(PO)_n$ wherein m is an integer of about 2–10 and n is an integer from about 2–20. R can be any suitable radical such as a straight chain alkyl group having from about 6–20 carbon atoms.

Other useful nonionic surfactants of the invention comprise capped aliphatic alcohol alkoxylates. These end caps include but are not limited to methyl, ethyl, propyl, butyl, benzyl and chlorine. Preferably, such surfactants have a molecular weight of about 400 to 10,000. Capping improves the compatibility between the nonionic and the oxidizers hydrogen peroxide and percarboxylic acid, when formulated into a single composition. An especially preferred nonionic is Plurafac LF131 from BASF with a structure:

$C_{12-7}(EO)_7(BO)_{1.7}R$ wherein R is a $C_{1-6}$ alkyl moiety and preferably with 60% of the structures being methyl capped, R comprises $CH_3$. Other useful nonionic surfactants are alkylpolyglycosides.

Another useful nonionic surfactant of the invention comprises a fatty acid alkoxylate wherein the surfactant comprises a fatty acid moiety with an ester group comprising a block of EO, a block of PO or a mixed block or heteric group. The molecular weights of such surfactants range from about 400 to about 10,000, a preferred surfactant comprises an EO content of about 30–50 wt-% and wherein the fatty acid moiety contains from about 8 to about 18 carbon atoms.

Similarly, alkyl phenol alkoxylates have also been found useful in the manufacture of the rinse agents of the invention. Such surfactants can be made from an alkyl phenol moiety having an alkyl group with 4 to about 18 carbon atoms, can contain an ethylene oxide block, a propylene oxide block or a mixed ethylene oxide, propylene oxide block or heteric polymer moiety. Preferably such surfactants have a molecular weight of about 400 to about 10,000 and have from about 5 to about 20 units of ethylene oxide, propylene oxide or mixtures thereof.

Solubilizer

The compositions of the invention can also include a hydrotrope, coupler or solubilizer. Such materials can be used to ensure that the composition remains phase stable and in a single highly active form. The solubilizer is particularly useful in solubilizing certain carboxylic and peroxycarboxylic acid constituents within the rinse aid of the invention. Such hydrotrope solubilizers or couplers can be used at concentrations which maintain phase stability.

Representative classes of hydrotrope solubilizers or coupling agents include anionic surfactants such as an alkyl sulfate, an alkyl or alkane sulfonate, a linear alkyl benzene or naphthalene sulfonate, a secondary alkane sulfonate, alkyl ether sulfate or sulfonate, an alkyl phosphate or phosphonate, dialkyl sulfosuccinic acid ester, sugar esters (e.g., sorbitan esters) and a $C_{8-10}$ alkyl glucoside.

Preferred coupling agents for use in the rinse agents of the invention include sulfonates for example such as n-alkyl sulfonates, n-octane sulfonate and, aromatic sulfonates such as an alkyl benzene sulfonates (e.g., sodium xylene sulfonate, dialkyl ether diphenyl ether sulfonate, or naphthalene sulfonate). Many hydrotrope solubilizers independently exhibit some degree of antimicrobial activity at low pH. Such action adds to the efficacy of the invention but is not a primary criterion used in selecting an appropriate solubilizing agent. Since the presence of the peroxy acid material in the protonated neutral state provides beneficial biocidal or sanitizing activity, the coupling agent should be selected not for its independent antimicrobial activity but for its ability to provide effective single phase composition stability in the presence of substantially insoluble peracid materials and the more soluble compositions of the invention.

C. Formulation

The compositions of the invention can be formulated by combining a nonionic surfactant sheeting agent and other components with the materials that form the sanitizing destaining composition, the carboxylic acid blend, hydrogen peroxide and optionally, a hydrotrope solubilizer. The compositions can also be formulated with preformed peroxy acids. The preferred compositions of the invention can be made by mixing the carboxylic acid or mixture thereof with an optional hydrotrope solubilizer or coupler, reacting the mixture with hydrogen peroxide and then adding the balance of required ingredients to provide destaining and sanitizing action.

A stable equilibrium mixture is produced containing the carboxylic acid or blend with hydrogen peroxide and allowing the mixture to stand for 1–7 days at 15° C. or more. With this preparatory method, an equilibrium mixture will be formed containing an amount of hydrogen peroxide, unoxidized acid, oxidized or peroxyacid and typically unmodified couplers, solubilizer, or stabilizers.

D. Concentrated Use Compositions

The invention contemplates a concentrate composition which is diluted to a use solution prior to its utilization as a sanitizer. Primarily for reasons of economics, the concentrate would normally be marketed and an end user would preferably dilute the concentrate with water or an aqueous diluent to a use solution.

The general constituent concentrations of the sanitizing, destaining concentrate formulated in accordance with the invention may be found in the Table below.

TABLE 1

| | (wt-%) at Equilibrium | | |
|---|---|---|---|
| Constituent | Preferred | More Preferred | Most Preferred |
| $H_2O_2$ | 1–40 | 3–35 | 5–30 |
| Peroxy acid | 0.5–25 | 1–20 | 3–15 |
| Carboxylic acid | 5–75 | 10–50 | 15–40 |
| Solubilizer | 0.1–25 | 1–20 | 3–10 |
| Chelating Agent | 0–10 | 0.1–7.5 | 0.5–5 |
| Rinse Agent | 0–40 | 5–35 | 10–30 |
| Carrier | Balance | Balance | Balance |

E. Use Solutions

The level of active components in the concentrate composition is dependent on the intended dilution factor and the desired activity of the peroxy fatty acid compound and the desired acidity in the use solution. Generally, dilution of about 1 fluid ounce to about 1–15 gallons, i.e. a dilution of about 1 part to 125 parts by volume of service water up to a dilution of about 1 part to 2000 parts by volume of service water can be obtained with 2 to about 20 wt % total peracid in the concentrate. Higher use dilutions can be employed if elevated use temperature or extended exposure time (greater than 30 seconds) can be employed. In the typical use locus, the concentrate is diluted with a major proportion of water and used for destaining and sanitizing using commonly available tap or service water, with the materials being mixed at a dilution ratio of about 0.5 to about 10 ounces of concentrate per each 8 gallons of water.

At equilibrium, aqueous antimicrobial sanitizing use solutions can comprise at least about 1 part per million, preferably about 10 to 400 parts per million, and most preferably about 10 to 200 parts per million of the perfatty acid material; at least about 10 parts per million, typically about up to 300 parts per million and preferably about 15 to 200 parts per million, and most preferably about 40 to 160 parts per million, of the sheeting or rinsing agent; about 20 to 650 parts per million and preferably about 20 to 400 parts per million carboxylic acid; and about 20 to 1200 parts per million and preferably about 20 to about 500 parts per million of hydrogen peroxide. The aqueous use solution can further comprise at least about 10–200 ppm, preferably about 10 to about 50 ppm of the hydrotrope solubilizer, and have a pH in the use solution in the range of about 2 to about 9, preferably about 3 to about 8.

In use, the sanitizing composition may be used with a surfactant rinse aid. In the use environment the rinse aid may have the following concentrations (wt-%):

| | Preferred | More Preferred | Most Preferred |
|---|---|---|---|
| Surfactant Rinse Aid | 0.0002–0.005 | 0.0003–0.002 | 0.0004–0.002 |

F. Methods of Use

As noted above, compositions of the invention are useful in rinsing steps in industry accepted manual procedures and in commonly available warewashing machines. Manual procedures include three tub wash, rinse, sanitize processes known to those of skill in the art. These procedures generally have a sanitizing step which takes place at a temperature of between about 20° C. to 35° C. The configuration and construction of warewashing machines do vary from high temperature to low temperature machines and from manufacturer to manufacturer. However, all machines share common operating parameters in that the aqueous rinse compositions are sprayed on dishes in a rinse step at a generally fixed temperature for a generally fixed period of time. In such machines, the aqueous rinse composition is prepared by diluting rinse agent with an appropriate proportion of water, placing the aqueous rinse in a sump or other container and drawing and spraying the aqueous rinse from the sump. Such aqueous rinses often sprayed through nozzles attached to rotating bars or fixed sprayer nozzles attached or installed in the warewashing machine in a location that optimizes contact between the aqueous rinse and ware.

The nozzles are often manufactured with a geometry that enhances a spray pattern for complete coverage. The spray arms can be fixed or can reciprocate or rotate within the machine providing complete coverage. The diluted concentrate of the invention can be pumped at a rate of about 20 to 100, preferably 40 to 80 gallons per minute and is commonly contacted with dishes in a low temperature machine at temperatures between 120° and 140° F. In a high temperature machine, the aqueous rinse is sprayed at a rate of 1.0–2.5 gallons per rock at a temperature of about 150° to 190° F. The rinse cycle can extend in time for from about 9 to about 60 seconds, preferably about 9 to 30 seconds to ensure that the dishes are both fully rinsed and sanitized in the rinsing stage.

The term "sanitizing" is used in the description and methods of the invention indicates a reduction in the population of numbers of undesirable microorganisms by 5 orders of magnitude or greater (99.999% reduction) after a 30 second exposure time. In other words, 99.999% of the microbial population present in a test site are eliminated by using the composition of the invention, as measured by Germicidal and Detergent Sanitizing Action of Disinfectants, Official Methods of Analysis of the Association of Official Analytical Chemists, paragraph 960.09, and applicable subparagraphs, 15th Edition.

WORKING EXAMPLES

The following examples are intended to illustrate the invention and should not be construed to narrow its scope. One skilled in the art will readily recognize that these examples suggest many other ways in which the invention can be practiced.

WORKING EXAMPLE 1

A peracid based rinse agent was made with the following formulation:

| Raw Material | Wt % |
|---|---|
| Acetic acid | 30.0 |
| Hydrogen peroxide (30 wt % active) | 26 |
| DEQUEST ® 2010 (1-hydroxyethylidine-1, 1-diphosphonic acid) | 1.5 |
| Sodium alkyl sulfonate (30% w/v) | 16.67 |
| Plurafac LF131 nonionic ($C_{12.7}$ $(EO)_7$ $(BO)_{1.7}$) | 15.0 |
| Octanoic acid | 4.0 |
| Water | 6.83 |

After equilibration for two weeks, the formula contained about 5.6 wt % hydrogen peroxide (calculated on 100 wt % active basis) and a total of 5.3% peracid (combined peracetic and peroctanoic). The formulation was used at a level of 4 milliliters of rinse agent per rack of ware (30 parts per million total peracid in the aqueous rinse). This concentration provided sufficient sanitization and sheeting action. Formulations made with the peracid material was shown to produce substantially no corrosion but did under certain circumstances produce some slight yellowing.

Similar formulations prepared with no peracid precursor materials with a rinse agent and using sodium hypochlorite as a source of active $Cl_2$, used at a concentration of 50 parts per million active chlorine and 100 parts per million active chlorine, showed marked darkening after one cycle and a gray-black uniform appearance after 5 cycles. At 100 ppm active chlorine the graying and blackening appeared more rapidly.

WORKING EXAMPLE 2

A corrosion test was undertaken using the composition formulated in Working Example 1. Three silver plate spoons were placed in a low temperature dishwasher. Four mls. of sanitizing rinse aid was added as the machine was filling for the rinse. At end of each cycle silver was wiped, gently, to dry. Each cycle was run using a Detergent (Ultra Klene Plus), and city water.

| Cycle | Wash Temp. | Rinse Temp. |
|---|---|---|
| 1 | 130° | 138° |
| 2 | 132° | 144° |
| 3 | 134° | 128° |
| 4 | 120° | 112° |
| 5 | 140° | 135° |

After five cycles there was no noticeable effect on the silver plate spoons.

WORKING EXAMPLE 3

A test was then run to check the effect of chlorine versus the composition of the invention on silver plate. The following compositions were then formulated.

| EXAMPLE | COMPOSITION |
|---|---|
| 3A (CONTROL) | Control — no chlorine, no peracid |
| 3B (COMPARATIVE) | Chlorine — 100 ppm + Ultra-Dry |

-continued

| EXAMPLE | COMPOSITION |
|---|---|
| 3C (COMPARATIVE) | Chlorine — 50 ppm + Ultra-Dry |
| 3D (WORKING) | 4 mls. of the Sanitizing Rinse Aid formulated in Example 1. |

The conditions of the analysis included the use of city water at 102–110 ppm hardness in a low temperature machine. The detergent, (Ultra Klene Plus from ECOLAB), was used at a rate of 6 mls/rack and applied through auto injection. The chlorinated rinse aid (Ultra Dry from ECOLAB), was used at a rate of 1 ml/rack, and applied through auto injection. The silver plate used was Oneida® Brand, knives and bouillon spoons.

The chlorine source (Eco-San) had 8.3% active chlorine. The sanitizing rinse aid used had 5.94% $H_2O_2$, 5.25% peracetic acid, with a total percentage of 3.90% of active oxygen added manually (4 mls.) while the machine was filling for rinse.

RESULTS

After 10 cycles the chlorine treated silverware had undergone a dramatic change in appearance and corrosion. The peracid system little change in the ware after 10 cycles.

| | APPEARANCE OF SILVER AFTER TESTING | | | |
|---|---|---|---|---|
| # Washes | WORKING EXAMPLE 3A | WORKING EXAMPLE 3B | WORKING EXAMPLE 3C | WORKING EXAMPLE 3D |
| 1 | — | Uniform dark frosty gray, slight gloss | Uniform frosty gray, some gloss | Very, very slight yellowing |
| 5 | | Uniform dull gray, no gloss | Uniform frosty gray, some gloss | Very slight yellowing |
| 10 | Same as initial | — | — | Slight yellowing |

WORKING EXAMPLE 4

An analysis of the antimicrobial nature of the composition of the invention was undertaken using Germicidal and Detergent Sanitizing Action of Disinfectants, (A.O.A.C. Official Methods of Analysis, 15th edition, 1990), with a test temperature of 120° F.±0.4° F. (for *S. aureus*), and 120° F.±0.3° F. (*E. coli*).

The flasks were tempered at least 10 minutes prior to test and with 30 seconds exposure time of test system to test substance. The post Test Incubation was 48 hours at 37° C.±0.5° C.

The test solution for Working Examples 4A through 4C comprised:

| constituent | wt-% |
|---|---|
| $H_2O_2$ | 6.90 |
| Peroxyacetic Acid | 4.40 |
| Octanoic Acid (including peroxyoctanoic acid) | 3.90 |
| Inert Ingredients (including carrier) | 84.80 |

Each dilution of test substance was tested in triplicate. Ninety-nine ml of use solution was dispensed in sterile flasks and tempered to 120° F. at 9:35 a.m. Twenty minutes later at 9:55 a.m., 1.0 ml of test solution was added to each flask. After 30 seconds exposure, 1.0 ml of test system/substance was transferred to 9.0 ml of neutralizer. Tubes were plated using serial dilutions and pour plate techniques. The surviving numbers of test system are an average of the three flask results.

RESULTS

Calculation for percent reduction is as follows.

$$\% \text{ Reduction} = \frac{\text{numbers control} - \text{survivor numbers}}{\text{numbers control}} \times (100)$$

| Working Example | Numbers Control #cfu/ml | Survivor Numbers #cfu/ml | % Reduction |
|---|---|---|---|
| | *Staphylococcus aureus* (ATCC 6538) | | |
| 4A | $87 \times 10^6$ | <10 | >99.999 |
| 4B | $87 \times 10^6$ | <10 | >99.999 |
| 4C | $87 \times 10^6$ | <10 | >99.999 |
| | *Escherichia coli* (ATCC 11229) | | |
| 4A | $116 \times 10^6$ | <10 | >99.999 |
| 4B | $116 \times 10^6$ | <10 | >99.999 |
| 4C | $116 \times 10^6$ | <10 | >99.999 |

The composition of the invention has demonstrated food contact sanitizing efficacy at 120° F. when diluted at 1 ounce per 14 gallons of 500 ppm synthetic hard water (as $CaCO_3$) or at 0.056% concentration with a 30 second exposure at 120° F.±0.4° F. by providing>99.999%, in test system numbers.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of sanitizing and destaining tableware, said method comprising the step of applying during a rinse step at least about 100 ppm of a sanitizing and destaining concentrate composition comprising:

(a) from about 0.5 wt-% to 25 wt-% of peroxycarboxylic acid;

(b) from about 5 wt-% to 75 wt-% of carboxylic acid wherein said carboxylic acid comprises a mixture of octanoic acid and acetic acid;

(c) from about 1 wt-% to 40 wt-% of hydrogen peroxide; and (d) a balance of carrier;

wherein said sanitizing and destaining concentrate composition is non-corrosive and non-filmforming with said tableware.

2. The method of claim 1 wherein said sanitizing and destaining concentrate composition is applied to the table ware in a concentration ranging from about 100 ppm to 2000 ppm.

3. The method of claim 1 wherein said sanitizing and destaining concentrate composition is applied in an automated warewashing machine.

4. The method of claim 3 wherein said automated warewashing machine applies said concentrate composition at a temperature ranging from about 120° F. to 140° F.

5. The method of claim 3 wherein said automated warewashing machine applies said concentrate composition at a temperature of about 180° F. to 195° F.

6. The method of claim 1 wherein said sanitizing and destaining concentrate composition is used in a manual procedure.

7. The method of claim 6 wherein said manual procedure applies said sanitizing and destaining concentrate composition at a temperature ranging from about 20° C. to 35° C.

8. The method of claim 1 wherein said sanitizing and destaining concentrate composition is applied in combination with a surfactant rinse aid.

9. The method of claim 8 wherein said sanitizing and destaining concentrate composition and said rinse aid are intermixed prior to application.

10. The method of claim 8 wherein said sanitizing and destaining concentrate composition and said rinse aid are codispensed separately during application.

11. The method of claim 1 wherein said acetic acid is present in a ratio ranging from about 20 to 1 to about 1 to 2 in relation to said octanoic acid.

12. The method of claim 1 wherein said peroxycarboxylic acid comprises the reaction product of said carboxylic acids and hydrogen peroxide.

13. The method of claim 1 wherein said peroxycarboxylic acid comprises the reaction product of said carboxylic acid and hydrogen peroxide, wherein said acetic acid is present in a ratio ranging from about 10 to 1 to about 1 to 1 in relation to said octanoic acid.

14. The method of claim 1 wherein said sanitizing and destaining concentrate composition further comprises a solubilizer.

15. The method of claim 14 wherein said solubilizer comprises an n-alkyl sulfonate.

16. The method of claim 1 wherein said sanitizing and destaining concentrate composition comprises a sequestrant.

17. A method of sanitizing and destaining silverware, said method comprising the step of applying during a rinse step a sanitizing and destaining concentrate composition to silverware at a rate of 100 ppm to 2000 ppm, said sanitizing and destaining concentrate composition comprising:

(a) from about 1 wt-% to 20 wt-% of a $C_{1-6}$ peroxycarboxylic acid;

(b) from about 10 wt-% to 50 wt-% of carboxylic acid mixture comprising acetic acid and octanoic acid;

(c) from about 3 wt-% to 35 wt-% of hydrogen peroxide; and (d) a balance of carrier;

wherein said sanitizing and destaining concentrate composition is non-corrosive and non-filmforming with said silverware.

18. The method of claim 17 wherein said sanitizing and destaining concentrate composition is applied in an automated warewashing machine.

19. The method of claim 18 wherein said sanitizing and destaining concentrate composition is applied at a temperature ranging from about 120° F. to 140° F.

20. The method of claim 18 wherein said sanitizing and destaining concentrate composition is applied at a temperature of about 180° to 195° F.

21. The method of claim 17 wherein said sanitizing and destaining concentrate composition is applied to said silverware manually at a temperature ranging from about 20° C. to 35° C.

22. The method of claim 17 wherein said sanitizing and destaining concentrate composition is applied in combination with a surfactant rinse agent.

23. The method of claim 22 wherein said surfactant rinse agent is separately codispensed with said sanitizing and destaining concentrate composition.

24. The method of claim 22 wherein said surfactant rinse agent is inter mixed with said sanitizing and destaining concentrate composition prior to dispensing.

25. The method of claim 17, wherein the silverware is washed before being subjected to said sanitizing and destaining concentrate composition.

26. The method of claim 17 wherein said sanitizing and destaining concentrate composition comprises a n-alkyl sulfonate solubilizer.

27. The method of claim 17 wherein said sanitizing and destaining concentrate composition comprises a sequestrant.

28. A method of sanitizing and destaining silverware, said method comprising the steps of applying during a rinse step a sanitizing and destaining concentrate composition to silverware at a rate of 100 ppm to 2000 ppm, said sanitizing and destaining concentrate composition comprising:

(a) from about 1 wt-% to 20 wt-% of a mixture comprising peroxyacetic acid and peroxyoctanoic acid;

(b) from about 10 wt-% to 50 wt-% of carboxylic acid comprising a mixture of acetic acid, and octanoic acid, said acetic acid and said octanoic acid present in a ratio ranging from about 10 to 1 to about 1 to 1, respectively;

(c) from about 3 wt-% to 35 wt-% of hydrogen peroxide;

(d) from about 1 to 20 wt-% of a solubilizer; and (e) a balance of carrier wherein said peroxycarboxylic acid comprised a reaction product of said acetic acid, octanoic acid, and hydrogen peroxide;

wherein said sanitizing and destaining concentrate composition is non-corrosive and non-filmforming with said silverware.

29. The method of claim 28 wherein said sanitizing and destaining concentrate composition is applied in an automated warewashing machine.

30. The method of claim 29 wherein said sanitizing and destaining concentrate composition is applied at a temperature ranging from about 120° F. to 140° F.

31. The method of claim 29 wherein said sanitizing and destaining concentrate composition is applied at a temperature of about 180° to 195° F.

* * * * *